US006809074B2

(12) United States Patent
Moe et al.

(10) Patent No.: US 6,809,074 B2
(45) Date of Patent: Oct. 26, 2004

(54) MODIFIED STARCH-BASED POLYMER-CONTAINING FABRIC CARE COMPOSITIONS AND METHODS EMPLOYING SAME

(75) Inventors: Jennifer Leupin Moe, West Chester, OH (US); Wolfgang Ulrich Spendel, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 623 days.

(21) Appl. No.: 09/838,512

(22) Filed: Apr. 19, 2001

(65) Prior Publication Data

US 2002/0045562 A1 Apr. 18, 2002

Related U.S. Application Data

(60) Provisional application No. 60/198,710, filed on Apr. 20, 2000.

(51) Int. Cl.[7] ..... C11D 3/22; C11D 3/37

(52) U.S. Cl. ..... 510/473; 510/470; 8/137

(58) Field of Search ..... 510/470, 473; 8/137

(56) References Cited

U.S. PATENT DOCUMENTS 4,011,169 A 3/1977 Diehl et al.
4,179,382 A 12/1979 Rudkin et al.
6,384,011 B1 * 5/2002 Leupin et al. ..... 510/473
6,579,840 B1 * 6/2003 Heltovics ..... 510/327
2002/0045562 A1 * 4/2002 Moe et al. ..... 510/474

FOREIGN PATENT DOCUMENTS

EP 0 526 800 A1 7/1992
EP 0 615 979 A2 9/1994
WO WO 94/24169 10/1994
WO WO 99/14245 * 3/1999 ..... C08B/11/20
WO WO 99/14295 * 3/1999 ..... C11D/3/22

* cited by examiner

*Primary Examiner*—Brian P. Mruk
(74) *Attorney, Agent, or Firm*—C. Brant Cook; Julia A. Glazer; Brahm J. Corstanje

(57) ABSTRACT

Compositions and methods which utilize certain modified starch-based polymer and/or oligomer materials, particularly modified amylose and/or modified amylopectin materials, as fabric treatment agents that can impart fabric appearance and integrity benefits to fabrics and textiles laundered in washing solutions which contain such materials. The modified starch-based polymer and/or oligomer materials can be added to wash solutions by incorporating them into a laundry and/or fabric care composition, a fabric softener or by adding them separately to the washing solution. The modified starch-based polymer and/or oligomer materials are described herein primarily as liquid or granular detergent additives but the present invention is not meant to be so limited.

16 Claims, No Drawings

MODIFIED STARCH-BASED POLYMER-CONTAINING FABRIC CARE COMPOSITIONS AND METHODS EMPLOYING SAME

CROSS REFERENCE TO RELATED APPLICATIONS

This application claims priority under 37 U.S.C. §119(e) to U.S. Provisional Application Ser. No. 60/198,710, filed Apr. 20, 2000.

TECHNICAL FIELD

The present invention relates to compositions, in any form, preferably liquid or granular form, for use in laundry and/or fabric care applications, wherein the compositions comprise certain modified starch-based polymer and/or oligomer materials which impart appearance and integrity benefits to fabrics and textiles laundered in washing solutions formed from such compositions. The modified starch-based polymer and/or oligomer materials can be added to wash solutions by incorporating them into a laundry and/or fabric care composition, a fabric softener or by adding them separately to the washing solution. The modified starch-based polymer and/or oligomer materials are described herein primarily as liquid or granular detergent additives but the present invention is not meant to be so limited.

BACKGROUND OF THE INVENTION

It is, of course, well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Also, dislodged fibers are more susceptible to damage which causes increased light scattering to decrease fabric color depth or strength. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry detergent products that would associate themselves with the fibers of the fabrics and textiles laundered using such detergent products and thereby reduce or minimize the tendency of the laundered fabric/textiles to deteriorate in appearance. Any such detergent product additive material should, of course, be able to benefit fabric appearance and integrity without unduly interfering with the ability of the laundry detergent to perform its fabric cleaning function. The present invention is directed to the use of modified starch-based polymer and/or oligomer materials in laundry and/or fabric care applications which perform in this desired manner.

SUMMARY OF THE INVENTION

Modified starch-based polymer and/or oligomer materials, preferably modified amylose (represented by Formula I below) and/or modified amylopectin (represented by Formula II below) both of which are described in Kirk-Othmer's *Encyclopedia of Chemical Technology* 4th Edition, Vol. 22, pp. 701–703, starch, generally, is described at pp. 699–719, which are suitable for use in laundry and/or fabric care operations and provide the desired fabric appearance and integrity benefits can be characterized by the following general formulas, alone or in combination:

I

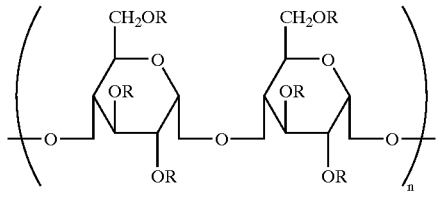

or

II

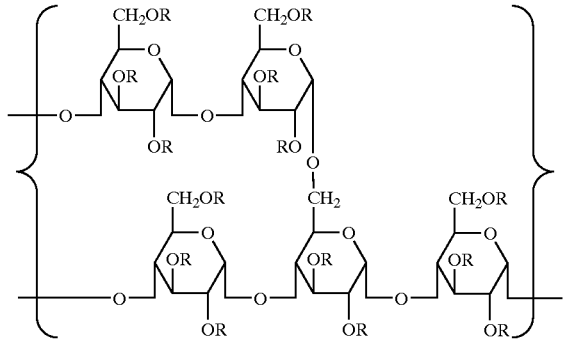

wherein each R is selected from the group consisting of $R_2$, $R_C$, and

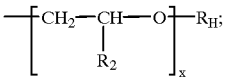

wherein:

each $R_2$ is independently selected from the group consisting of H and $C_1$–$C_4$ alkyl;

each $R_c$ is

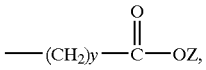

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$–$C_{12}$ aryloxy-2-hydroxyalkyl,

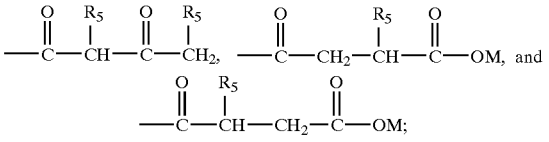

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

M is a suitable cation selected from the group consisting of $Na^+$, $K^+$, $\frac{1}{2}Ca^{2+}$, $\frac{1}{2}Mg^{2+}$, or $^+NH_jR_k$ wherein j and k are independently from 0 to 4 and wherein j+k is 4 and R in this formula is any moiety capable of forming a cation, preferably methyl and/or ethyl group or derivative;

each x is from 0 to about 5;

each y is from about 1 to about 5; and provided that:

the Degree of Substitution for group $R_H$ is between about 0.001 and about 0.1, more preferably between about 0.005 and about 0.05, and most preferably between about 0.01 and about 0.05;

the Degree of Substitution for group $R_C$ wherein Z is H or M is between about 0 and about 2.0, more preferably between about 0.05 and about 1.0, and most preferably between about 0.1 and about 0.5;

if any $R_H$ bears a positive charge, it is balanced by a suitable anion; and two $R_4$'s on the same nitrogen can together form a ring structure selected from the group consisting of piperidine and morpholine.

The modified starch-based polymer and/or oligomer materials defined above can be used as a washing solution additive in either granular or liquid form. Alternatively, they can be admixed to granular detergents, dissolved/dispersed in liquid laundry and/or fabric care compositions or added to a fabric softening composition. The forgoing description of uses for the modified starch-based polymer and/or oligomer materials defined herein are intended to be exemplary and other uses will be apparent to those skilled in the art and are intended to be within the scope of the present invention.

The laundry and/or fabric care compositions herein comprise from about 0.1% to about 80%, more preferably from about 1% to about 50%, even more preferably from about 2% to about 30% by weight of the modified starch-based polymer and/or oligomer materials of the present invention and optionally, but preferably from about 1% to about 80% by weight of a detersive surfactant, from about 0.1% to about 80% by weight of an organic or inorganic detergency. The detersive surfactant and detergency builder materials can be any of those useful in conventional laundry detergent products.

Aqueous solutions of the modified starch-based polymer and/or oligomer materials of the subject invention comprise from about 0.5 ppm to about 1000 ppm, more preferably from about 0.875 ppm to about 700 ppm, most preferably from about 10 ppm to about 200 ppm of the modified starch-based polymer and/or oligomer materials dissolved in water.

In its method aspect, the present invention relates to the laundering or treating of fabrics and textiles in aqueous washing or treating solutions, especially in-home laundering and/or treating solutions and/or solutions used to treat and/or launder finished garments, formed from effective amounts of the laundry and/or fabric care compositions described herein, or formed from the individual components of such compositions. Laundering of fabrics and textiles in such washing solutions, followed by rinsing and drying, imparts fabric appearance benefits to the fabric and textile articles so treated. Such benefits can include improved overall appearance, pill/fuzz reduction, antifading, improved abrasion resistance, and/or enhanced softness.

All percentages, ratios and proportions herein are on a weight basis unless otherwise indicated. All documents cited herein are hereby incorporated by reference.

DETAILED DESCRIPTION OF THE INVENTION

As noted, when fabric or textiles are laundered in wash solutions which comprise the modified starch-based polymer and/or oligomer materials of the present invention fabric appearance and integrity are enhanced. The modified starch-based polymer and/or oligomer materials can be added to wash solutions by incorporating them into a laundry and/or fabric care composition, a fabric softener or by adding them separately to the washing solution. The modified starch-based polymer and/or oligomer materials are described herein primarily as liquid or granular detergent additives but the present invention is not meant to be so limited. The modified starch-based polymer and/or oligomer materials, laundry and/or fabric care composition components, optional ingredients for such compositions and methods of using such compositions, are described in detail below, particularly in the Examples. All percentages are by weight of the composition unless otherwise specified.

A) Modified Starch-based Polymer and/or Oligomer Materials

The essential component of the compositions of the present invention comprises one or more modified starch-based polymer and/or oligomer materials, such as modified amylose (Formula I below) and/or modified amylopectin (Formula II below). Such materials have been found to impart a number of appearance benefits to fabrics and textiles laundered in aqueous washing solutions formed from laundry and/or fabric care compositions which contain such modified starch-based polymer and/or oligomer materials. Such fabric appearance benefits can include, for example, improved overall appearance of the laundered fabrics, reduction of the formation of pills and fuzz, protection against color fading, improved abrasion resistance, etc. The modified starch-based polymer and/or oligomer materials used in the compositions and methods herein can provide such fabric appearance benefits with acceptably little or no loss in cleaning performance provided by the laundry and/or fabric care compositions into which such materials are incorporated.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. One suitable type of modified starch-based polymer and/or oligomer fabric treatment material for use herein has an average molecular weight of from about 5,000 to about 2,000,000, preferably from about 50,000 to about 1,000,000.

The modified starch-based fabric treatment component of the laundry and/or fabric care compositions herein will generally comprise from about 0.1% to about 5% by the weight of the laundry and/or fabric care composition. More preferably, such modified starch-based polymer and/or oligomer materials will comprise from about 0.5% to about 4% by weight of the laundry and/or fabric care compositions, most preferably from about 0.75% to about 3%. However, as discussed above, when used as a washing solution additive, i.e. when the modified starch-based fabric treatment component is not incorporated into a laundry and/or fabric care composition, the concentration of the modified starch-based component can comprise from about 0.1% to about 80% by weight of the additive material.

One suitable group of modified starch-based polymer and/or oligomer materials (modified amylose (I) and modified amylopectin (II)) for use herein is characterized by the following formulas, alone or in combination

I

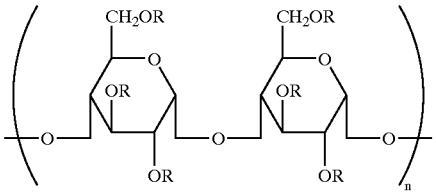

or

II

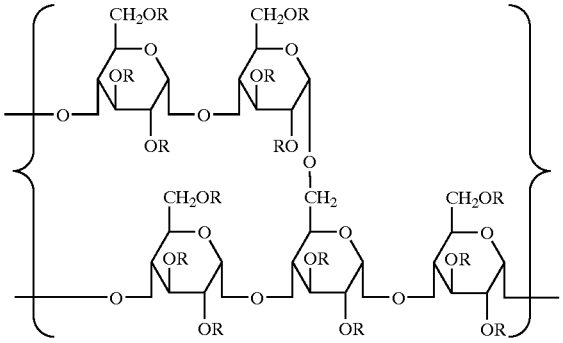

wherein each R is selected from the group consisting of $R_2$, $R_C$, and

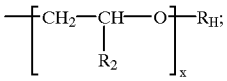

wherein:

each $R_2$ is independently selected from the group consisting of H and $C_1$–$C_4$ alkyl;

each $R_c$ is

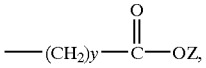

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$ N-alkyl, $(R_4)_3$ N-2-hydroxyalkyl, $C_6$–$C_{12}$ aryloxy-2-hydroxyalkyl,

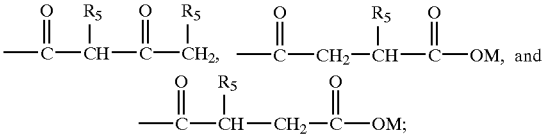

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

M is a suitable cation selected from the group consisting of $Na^+$, $K^+$, $\frac{1}{2}Ca^{2+}$, $\frac{1}{2}Mg^{2+}$, or $^+NH_jR_k$ wherein j and k are independently from 0 to 4 and wherein j+k is 4 and R in this formula is any moiety capable of forming a cation, preferably methyl and/or ethyl group or derivative;

each x is from 0 to about 5;

each y is from about 1 to about 5; and provided that:

the Degree of Substitution for group $R_H$ is between about 0.001 and about 0.1, more preferably between about 0.005 and about 0.05, and most preferably between about 0.01 and about 0.05;

the Degree of Substitution for group $R_C$ wherein Z is H or M is between about 0 and about 2.0, more preferably between about 0.05 and about 1.0, and most preferably between about 0.1 and about 0.5;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous D-glucose unit, wherein an anhydrous D-glucose unit is a six membered ring as shown in the repeating unit of the general structures above. It is understood that in addition to the required number of $R_C$ components wherein Z is H or M, there can be, and most preferably are, additional $R_C$ components wherein Z is a group other than H or M.

The production of materials according to the present invention is further defined in the Examples below.

Laundry and/or Fabric Care Compositions

The laundry and/or fabric care compositions of the present invention also comprise, in addition to one or more modified starch-based polymer and/or oligomer materials of the present invention described herein before, one or more adjunct materials, preferably compatible with the modified starch-based polymer and/or oligomer material(s). The term "adjunct materials", as used herein, means any liquid, solid or gaseous material selected for the particular type of laundry and/or fabric care composition desired and the form of the product (e.g., liquid; granule; powder; gel composition), which materials are also preferably compatible with the modified starch-based polymer and/or oligomer materials of the present invention. Granular compositions can also be in "compact" form and the liquid compositions can also be in a "concentrated" form.

The specific selection of adjunct materials are readily made by considering the surface, item or fabric to be cleaned, and the desired form of the composition for the laundry and/or fabric care conditions during use (e.g., through the wash detergent use). Examples of suitable adjunct materials include, but are not limited to, surfactants, builders, bleaches, bleach activators, bleach catalysts, non-activated enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, hydrolyzable surfactants, perservatives, anti-oxidants, anti-shrinkage agents, anti-wrinkle agents, germicides, fungicides, color speckles, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101.

Preferably an effective amount of one or more modified starch-based polymer and/or oligomer materials described above are included in compositions useful for laundering a variety of fabrics in need of treatment.

As used herein, "effective amount of one or more modified starch-based polymer and/or oligomer materials" refers to the quantity of modified starch-based polymer and/or oligomer materials of the present invention described hereinbefore necessary to achieve the yarn strength increase necessary in the specific laundry and/or fabric care composition. Such effective amounts are readily ascertained by one of ordinary skill in the art and is based on many factors, such as the particular modified starch-based polymer and/or oligomer material used, the laundry and/or fabric care application, the specific composition of the laundry and/or fabric care composition, and whether a liquid or dry (e.g., granular, powder) composition is required, and the like.

The laundry and/or fabric care compositions of the present invention comprise:

(a) one or more modified starch-based polymer and/or oligomer materials in accordance with the present invention; and (b) one or more adjunct materials.

Preferably, the laundry and/or fabric care compositions comprise from about 0.0001%, preferably from about 0.001%, more preferably from about 0.01% by weight of the laundry and/or fabric care compositions of one or more modified starch-based polymer and/or oligomer materials of the present invention, to about 10%, preferably to about 2%, more preferably to about 1%, most preferably to about 0.1%.

Preferably, the laundry and/or fabric care compositions of the present invention comprise one or more modified starch-based polymer and/or oligomer materials of the present invention such that the modified starch-based polymer and/or oligomer materials are present in the laundry and/or fabric care compositions of the present invention at a level of from about 0.0001%, preferably from about 0.001%, more preferably from about 0.01% to about 10%, preferably to about 2%, more preferably to about 1%, most preferably to about 0.1% of modified starch-based polymer and/or oligomer material by weight of the laundry and/or fabric care composition.

Several examples of various laundry and/or fabric care compositions wherein the modified starch-based polymer and/or oligomer materials of the present invention may be employed are discussed in further detail below. Also, the laundry and/or fabric care compositions may include from about 1% to about 99.9% by weight of the composition of the adjunct materials.

As used herein, "fabric laundry and/or fabric care compositions" include hand and machine laundry and/or fabric care compositions including laundry and/or fabric care additive compositions and compositions suitable for use in the soaking and/or pretreatment of stained fabrics. The fabric laundry and/or fabric care compositions and/or methods and/or processes of the present invention are preferably for in-home use and/or for use on finished garments.

When the laundry and/or fabric care compositions of the present invention are formulated as compositions suitable for use in a laundry and/or fabric care machine washing method, the compositions of the present invention preferably contain both a surfactant and a builder compound and additionally one or more adjunct materials preferably selected from organic polymeric compounds, bleaching agents, additional enzymes, suds suppressors, dispersants, lime-soap dispersants, soil suspension and anti-redeposition agents and corrosion inhibitors. Laundry and/or fabric care compositions can also contain softening agents, as additional adjunct materials.

The compositions of the present invention can also be used as detergent additive products in solid or liquid form. Such additive products are intended to supplement or boost the performance of conventional detergent compositions and can be added at any stage of the laundry and/or fabric care process.

If needed the density of the laundry and/or fabric care compositions herein ranges from 400 to 1200 g/liter, preferably 500 to 950 g/liter of composition measured at 20° C.

The "compact" form of the laundry and/or fabric care compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition. In the compact compositions, the filler salt is present in amounts not exceeding 15% of the total composition, preferably not exceeding 10%, most preferably not exceeding 5% by weight of the composition. The inorganic filler salts, such as meant in the present compositions are selected from the alkali and alkaline-earth-metal salts of sulfates and chlorides. A preferred filler salt is sodium sulfate.

Liquid laundry and/or fabric care compositions according to the present invention can also be in a "concentrated form", in such case, the liquid laundry and/or fabric care compositions according the present invention will contain a lower amount of water, compared to conventional liquid detergents. Typically the water content of the concentrated liquid laundry and/or fabric care composition is preferably less than 40%, more preferably less than 30%, most preferably less than 20% by weight of the laundry and/or fabric care composition.

Adjunct Materials

While not essential for the purposes of the present invention, several conventional adjunct materials illustrated hereinafter are suitable for use in the laundry and/or fabric care compositions containing the irradiated enzymes of the present invention, and may be desirably incorporated in preferred embodiments of the invention, for example to assist or enhance cleaning performance, for treatment of the substrate to be cleaned, or to modify the aesthetics of the laundry and/or fabric care composition as is the case with perfumes, colorants, dyes or the like. The precise nature of these additional components, and levels of incorporation thereof, will depend on the physical form of the composition and the nature of the cleaning operation for which it is to be used. Unless otherwise indicated, the laundry and/or fabric care compositions of the invention may for example, be formulated in the form of a granular, powder, liquid, bar, paste, foam, tablet (including dimple tablet), and/or gel composition; heavy-duty detergent compositions, fine-fabric detergent compositions, fabric care composition, including rinse-added compositions, dryer-added compositions, car or carpet shampoos, as well as cleaning auxiliaries such as bleach additives and "stain-stick" or pre-treat types.

Adjunct Materials

In addition to the modified starch-based polymer and/or oligomer material, one or more adjunct ingredients may optionally, but preferably, be included in the compositions, products and/or systems comprising the modified starch-based polymer and/or oligomer material.

Surfactants—A wide range of surfactants can be used in the compositions of the present invention.

Surfactants included in the fully-formulated compositions afforded by the present invention comprise at least 0.01%, preferably at least about 0.1%, more preferably at least about 0.5%, even more preferably at least about 1%, most preferably at least about 3% to about 80%, more preferably to about 60%, most preferably to about 50% by weight of composition depending upon the particular surfactants used and the desired effects to be achieved.

The surfactant can be nonionic, anionic, amphoteric, amphophilic, zwitterionic, cationic, semi-polar nonionic, and mixtures thereof, nonlimiting examples of which are disclosed in U.S. Pat. Nos. 5,707,950 and 5,576,282. A typical listing of anionic, nonionic, amphoteric and zwitterionic classes, and species of these surfactants, is given in U.S. Pat. No. 3,664,961 issued to Norris on May 23, 1972. Preferred compositions comprise nonionic surfactants and/or mixtures of nonionic surfactants with other surfactants, especially anionic surfactants.

Nonlimiting examples of surfactants useful herein include the conventional $C_8$–$C_{18}$ alkyl ethoxylates ("AE"), with EO about 1–22, including the so-called narrow peaked alkyl ethoxylates and $C_6$–$C_{12}$ alkyl phenol alkoxylates (especially ethoxylates and mixed ethoxy/propoxy), alkyl dialkyl amine oxide, alkanoyl glucose amide, $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

Bleaching System—The compositions of the present invention may comprise a bleaching system. Bleaching systems typically comprise a "bleaching agent" (source of hydrogen peroxide) and an "initiator" or "catalyst". Nonlimiting examples of bleaching systems are preformed peracids, metal-containing bleach catalysts and a source of hydrogen peroxide in conjunction with the bleach activator, such as NOBS. When present, bleaching agents will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

Enzymes—With respect to the enzymes in the particulate solid of the present invention, any suitable enzyme can be used. The preferred enzymes for use in the particulate solids of the present invention are selected from proteases, amylases, cellulases and mixtures thereof. Nonlimiting examples of other suitable enzymes include the following:

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, βglucanases, arabinosidases, hyaluronidase, chondroitinase, laccase, mannanases, more preferably plant cell wall degrading enzymes and non-cell wall-degrading enzymes (WO 98/39403 A) and can, more specifically, include pectinase (WO 98/06808 A, JP10088472 A, JP10088485 A); pectolyase (WO98/06805 A1); pectin lyases free from other pectic enzymes (WO9806807 A1); chondriotinase (EP 747,469 A); xylanase (EP 709,452 A, WO 98/39404 A, WO98/39402 A) including those derived from *microtetraspora flexuosa* (U.S. Pat. No. 5,683,911); isopeptidase (WO 98/16604 A); keratinase (EP 747,470 A, WO 98/40473 A); lipase (GB 2,297,979 A; WO 96/16153 A; WO 96/12004 A; EP 698,659 A; WO 96/16154 A); cellulase or endoglucanase (GB 2,294,269 A; WO 96/27649 A; GB 2,303,147 A; WO98/03640 A; see also neutral or alkaline cellulases derived from *chrysosporium lucknowense* strain VKM F-3500D as disclosed in WO9815633 A); polygalacturonase (WO 98/06809 A); mycodextranase (WO 98/13457 A); thermitase (WO 96/28558 A); cholesterol esterase (WO 98 28394 A); or any combination thereof; and known amylases; oxidoreductases; oxidases or combination systems including same (DE19523389 A1); mutant blue copper oxidases (WO9709431 A1), peroxidases (see for example U.S. Pat. No 5,605,832, WO97/31090 A1), mannanases (WO9711164, WO 99/09126, PCT/US00/00839); xyloglucanases (WO 98/50513, PCT/US/00/00839, WO 99/02663); laccases, see WO9838287 A1 or WO9838286 A1 or for example, those laccase variants having amino acid changes in myceliophthora or scytalidium laccase(s) as described in WO9827197 A1 or mediated laccase systems as described in DE19612193 A1), or those derived from *coprinus* strains (see, for example WO9810060 A1 or WO9827198 A1), phenol oxidase or polyphenol oxidase (JP10174583 A) or mediated phenol oxidase systems (WO9711217 A); enhanced phenol oxidase systems (WO 9725468 A WO9725469 A); phenol oxidases fused to an amino acid sequence having a cellulose binding domain (WO9740127 A1, WO9740229 A1) or other phenol oxidases (WO9708325 A, WO9728257 A1) or superoxide dismutases. Oxidoreductases and/or their associated antibodies can be used, for example with $H_2O_2$, as taught in WO 98/07816 A. Depending on the type of composition, other redox-active enzymes can be used, even, for example, catalases (see, for example JP09316490 A).

Methods of the Present Invention

A method for treating a fabric in need of treatment comprising contacting the fabric with a modified starch-based polymer and/or oligomer material such that the fabric in need of treatment is treated. Preferably the modified starch-based polymer and/or oligomer material is selected from the group consisting of: amylose, amylopectin and mixtures thereof.

Treated Article

A treated article results the methods of the present invention.

Product/Instructions of Use

This invention also may encompass the inclusion of instructions on the use of the modified starch-based polymer and/or oligomer material-containing compositions described herein with the packages containing the modified starch-based polymer and/or oligomer material-containing compositions or with other forms of advertising associated with the sale or use of the modified starch-based polymer and/or oligomer material-containing compositions. The instructions may be included in any manner typically used by consumer product manufacturing or supply companies. Examples include providing instructions on a label attached to the container holding the system and/or composition; on a sheet either attached to the container or accompanying it when purchased; or in advertisements, demonstrations, and/or other written or oral instructions which may be connected to the purchase or use of the modified starch-based polymer and/or oligomer material compositions.

Specifically the instructions will include a description of the use of the modified starch-based polymer and/or oligomer material compositions. The instructions, for instance, may additionally include information relating to the recommended amount of modified starch-based polymer and/or oligomer material compositions to apply to the article in need of treatment, if soaking or rubbing is appropriate to the article; the recommended amount of water, if any, to apply to the article before and after treatment; other recommended treatments.

The modified starch-based polymer and/or oligomer material compositions may be incorporated into a product, the product may be a kit comprising the modified starch-based polymer and/or oligomer material compositions. Accordingly, a product comprising a modified starch-based polymer and/or oligomer material composition of the present invention, the product further including instructions for using the modified starch-based polymer and/or oligomer material composition to treat an article, preferably a finished garment.

The following examples are illustrative of the present invention, but are not meant to limit or otherwise define its scope. All parts, percentages and ratios used herein are expressed as percent weight unless otherwise specified.

EXAMPLE 1

Powder heavy duty detergents in use (ppm) and neat product (% by wt.) in accordance with present invention are prepared as follows:

| Ingredient | A PPM | A Wt % | B PPM | B Wt % | C PPM | C Wt % |
|---|---|---|---|---|---|---|
| Surfactant | | | | | | |
| Na LAS | 384 | 25.10 | 300 | 21.20 | 222 | 15.86 |
| Na AS | 96 | 6.27 | 120 | 8.48 | 182 | 13.01 |
| Nonionic | 18 | 1.18 | 16 | 1.13 | 15 | 1.07 |

-continued

| Ingredient | A PPM | A Wt % | B PPM | B Wt % | C PPM | C Wt % |
|---|---|---|---|---|---|---|
| Builder | | | | | | |
| Aluminosilicate | 902 | 58.95 | 800 | 56.54 | 702 | 50.16 |
| Chelant | | | | | | |
| DTPA | 13 | 0.85 | 13 | 0.92 | 17 | 1.21 |
| Brightener | | | | | | |
| Br-64 | 4.5 | | 45 | 3.18 | 6.8 | 0.49 |
| Bleach | | | | | | |
| NOBS | 28 | 1.83 | 28 | 1.98 | 92 | 6.57 |
| PB1 or Percarbonate | 37 | 2.42 | 37 | 2.61 | 65 | 4.64 |
| Fabric Integrity/ Dye Transfer | | | | | | |
| Modified starch-based polymer and/or oligomer material | 15 | 0.98 | 45 | 3.18 | 60 | 4.29 |
| PVNO | 5.3 | | 5 | | 5.3 | |
| PVPVI | 5.3 | | 5 | | 5.3 | |
| Enzyme | | | 1 | | | |
| Suds Suppressor | 22 | 1.44 | | | 27 | 1.93 |
| | | Balance (water and minors) | | Balance (water and minors) | | Balance (water and minors) |

EXAMPLE 2

Granular Detergent Test Composition Preparation

Several heavy duty granular laundry and/or fabric care compositions are prepared containing various modified modified starch polymers. These granular laundry and/or fabric care compositions all have the following basic formula:

TABLE A

| Component | Wt. % |
|---|---|
| $C_{12}$ Linear alkyl benzene sulfonate | 9.31 |
| $C_{14-15}$ alkyl ether (0.35 EO) sulfate | 12.74 |
| Zeolite Builder | 27.79 |
| Sodium Carbonate | 27.31 |
| PEG 4000 | 1.60 |
| Dispersant | 2.26 |
| $C_{12-13}$ Alcohol Ethoxylate (9 EO) | 1.5 |
| Sodium Perborate | 1.03 |
| Soil Release Polymer | 0.41 |
| Enzymes | 0.59 |
| Modified Modified Starch-Based Polymer | 3.0 |
| Perfume, Brightener, Suds Suppressor, Other | Balance |
| Minors, Moisture, Sulfate | 100% |

EXAMPLE 3

Liquid Detergent Test Composition Preparation

Several heavy duty liquid laundry and/or fabric care compositions are prepared containing various modified modified starch polymers. These liquid laundry and/or fabric care compositions all have the following basic formula:

TABLE B

| Component | Wt. % |
|---|---|
| $C_{12-15}$ alkyl ether (2.5) sulfate | 38 |
| $C_{12}$ glucose amide | 6.86 |
| Citric Acid | 4.75 |
| $C_{12-14}$ Fatty Acid | 2.00 |
| Enzymes | 1.02 |
| MEA | 1.0 |
| Propanediol | 0.36 |
| Borax | 6.58 |
| Dispersant | 1.48 |
| Na Toluene Sulfonate | 6.25 |
| Modified Modified Starch-Based Polymer | 3.0 |
| Dye, Perfume, Brighteners, Preservatives, Suds | Balance |
| Suppressor, Other Minors, Water | 100% |

EXAMPLE 4

Synthesis of Modified Starch-Based Materials

The carboxylation of cellulose to produce CMC is a procedure that is well known to those skilled in the art. Such a carboxylation method can be used to produce modified starch-based polymers and/or oligomers, particularly modified amylose and/or modified amylopectin. To produce the modified strach-based materials of this invention, one adds during the starch making process the material, or materials, to be substituted. An example of such as procedure is given below. This same procedure can be utilized with the other substituent materials described herein by replacing the hexylchloride with the substituent material, or materials, of interest, for example, cetylchloride. The amount of material that should be added to the starch making process to achieve the desired degree of substitution will be easily calculated by those skilled in the art in light of the following Examples.

EXAMPLE 5

Modified Starch-Based Polymers Used in Test Laundry and/or Fabric Care Compositions The representative modified starch-based polymers used in the powder, granular and liquid laundry and/or fabric care compositions described in Examples 1, 2 and 3 are characterized in Table C. The General Polymer Parameters are common to all of the polymers, while the specific chemical structure of the materials tested are listed under the Specific Polymer Parameters.

TABLE C

General Polymer Parameters

| Molecular Parameters | Description |
|---|---|
| Polymer Backbone | Starch |
| Degree of Carboxymethylation | $DS_{RC}$ = 0–2.0; most preferred $DS_{RC}$ = 0.1–0.5. |
| Distribution of Carboxymethyls | Even and random distribution of carboxylmethyls along the backbone |
| Molecular Weight | Mw: 5,000–2,000000. Preferred: medium (approx 250,000 g/mol) |
| Type of Modification | Ether or ester modification (in addition to carboxymethylation). Mixed starch ether |
| Level of Modification | $DS_{RH}$ = about 0.001 to about 0.1 |

TABLE D

Specific Polymer Parameters

| ID | Polymer | Type of Modification*** | Types of Chemistry |
|---|---|---|---|
| A | Hexyl Starch | Hexyl ether | Chlorohexane added to Starch |
| B | Decyl Starch | Decyl ether | Chlorodecane added to Starch |
| C | C12–C13 alkoxy-2 hydroxypropyl Starch | C12–C13 alkoxy-2 hydroxypropyl ether | C12–C13 alkyl glycidyl ether added to Starch |
| D | Hexadecyl Starch | Hexadecyl ether | Chlorohexadecane added to Starch |
| E | Chloride salt of 3-trimethylammonio-2-hydroxypropyl ether of Starch | chloride salt of 3-trimethylammonio-2-hydroxypropyl ether | 2,3-epoxypropyltri-methyl ammonium chloride added to the Starch |
| F | Hexyl, carboxymethyl Starch | Hexyl ether Carboxymethyl ether | Chlorohexane and monochloroacetic acid added to Starch |
| G | Decyl, carboxymethyl Starch | Decyl ether Carboxymethyl ether | Chlorodecane and monochloroacetic acid added to Starch |
| H | Hexadecyl, carboxymethyl Starch | Hexadecyl ether Carboxymethyl ether | Chlorohexadecane and monochloroacetic acid added to Starch |
| I | [-(C(O)-CH(C16H33)-C(O)CH2(C16H33)] ester of Starch or 1,3-dioxo-2-hexadecyloctadecyl ester of Starch | | Cetyl Ketene Dimer added to Starch or modifications thereof. |

Starch is commercially available from National Starch
***$DS_{RH}$ for these materials was in the range of from about 0.001 to about 0.1

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above embodiments, the activated enzymes of the present invention can be formulated into any suitable detergent composition, non-limiting examples of which are described in U.S. Pat. No. 5,679,630 Baeck et al., issued Oct. 21, 1997; U.S. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the present invention in detail with reference to preferred embodiments, it will be clear to those skilled in the art that various changes and modifications may be made without departing from the scope of the invention, and the invention is not to be considered limited to what is described in the specification.

What is claimed is:

1. A laundry and/or fabric care composition comprising:

a) from about 1% to about 80% by weight of surfactants selected from the group consisting of nonicoic, anionic, cationic, amphoteric, zwitterionic surfactants, or mixtures thereof; and b) from about 0.1% to about 5.0% by weight of modified amylopectin polymers and/or oligomers of the general formula:

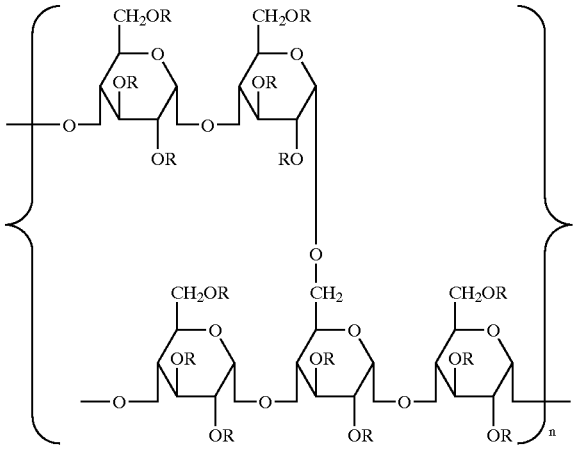

wherein each R is selected from the group consisting of $R_2$, $R_c$, and

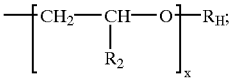

wherein:

each $R_2$ is independently selected from the group consisting of H end $C_1$–$C_4$ alkyl;

each $R_c$ is

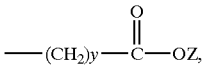

wherein each Z is independently selected from the group consisting of M, $R_2$, $R_c$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylarylaxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, $C_6$–$C_{12}$ aryloxy-2-hydroxyalkyl,

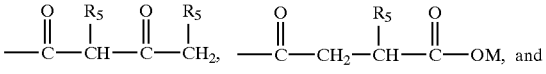

-continued

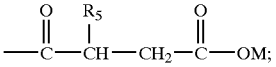

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinomilcyl, morpholinoalkyl, cycloalkylaminoalkyi and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$N-alkyl;

wherein:

M is a suitable cation selected from the group consisting of $Na^+$, $K^+$, $\frac{1}{2}Ca^{2+}$, $\frac{1}{2}Mg^{2+}$, or $^+NH_jR_K$, wherein j and k are independently from 0 to 4 and wherein j+k is 4 and R in this formula is any moiety capable of forming a cation, each x is from 0 to about 5;

each y is from about 1 to about 5; and provided that:

the Degree of Substitution for group $R_H$ is between about 0.001 and about 0.1, the Degree of Substitution for group $R_c$ wherein Z is H or M is between about 0 and about 2.0, if any $R_H$ bears a positive charge, it is balanced by a suitable anion; and two $R_4$'s on the same nitrogen can together form a ring atnacture selected from the group consisting of piperidine and morpholine.

2. The laundry and/or fabric care composition of claim 1, wherein each $R_H$ is independently selected from the group consisting of $C_5$–$C_{20}$ alkyl, $C_5$–$C_7$ cycloalkyl $C_7$–$C_{20}$ alkylaryl, $C_7$–$C_{20}$ arylalkyl, substituted alkyl, hydroxyalkyl, $C_1$ –$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, and $C_6$–$C_{12}$ aryloxy-2-hydroxyalkyl.

3. The laundry and/or fabric care composition of claim 1, wherein each $R_H$ is independently selected from the group consisting of

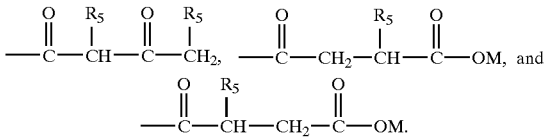

4. The laundry and/or fabric care composition of claim 1, wherein the modified amylopectin polymer and/or oligomer has an average molecular weight of from about 5,000 to about2,000,000.

5. The laundry and/or fabric care composition of claim 1, wherein the modified amylopectin polymer and/or oligomer has an average molecular weight of from about 10,000 to about 1,000,000.

6. A laundry additive composition comprising:

a) from about 1% to about 80% by weight of water; and b) from about 0.1% to about 80.0% by weight of modified amylopectin polymers and/or oligomers of the general formula:

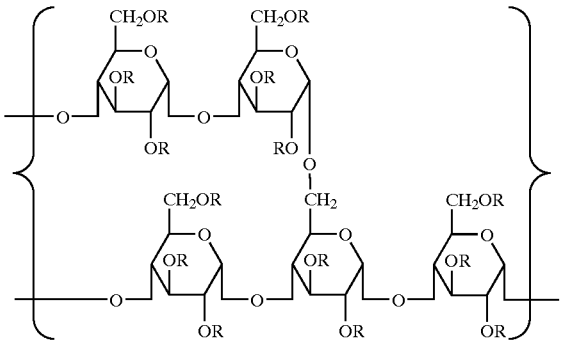

wherein each R is selected from the group consisting of $R_2$, $R_c$, and

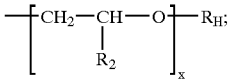

wherein:

each $R_2$ is independently selected from the group consisting of H and $C_1$–$C_4$ alkyl;

each $R_c$ is

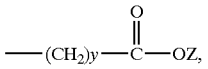

wherein each Z is independently selected from the group consisting of M, $R_2$, $R_c$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalky, $C_6$–$C_{12}$ aryloxy-2-hydroxyalkl,

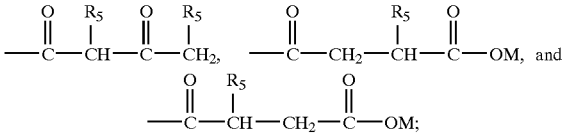

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidimoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

M is a suitable cation selected from the group consisting of $Na^+$, $K^+$, $\frac{1}{2}Ca^{2+}$, $\frac{1}{2}Mg^{2+}$, or $^+NH_jR_k$ wherein j end k independently from 0 to 4 and wherein j+k is 4 and R in this formula is any moiety capable of forming a cation, each x is from 0 to about 5;

each y is from about 1 to about 5; and provided that:

the Degree of Substitution for group $R_H$ is between about 0.001 and about 0.1, the Degree of Substitution for group $R_c$ wherein Z is H or M is between about 0 and about 2.0, if any $R_H$ bears a positive charge, it is balanced by a suitable anion; and two $R_4$'s on the same nitrogen can together form a ring structure selected from the group consisting of piperidine and morpholine.

7. The laundry additive composition of claim 6, wherein each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl,$(R_4)_3$N-2-hydroxyalkyl, and $C_6$–$C_{12}$ aryloxy-2-hydroxyalkyl.

8. The laundry additive composition of claim 6, wherein each $R_H$ is independently selected from the group consisting of

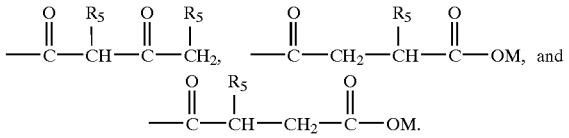

9. The laundry additive composition of claim 6, wherein the modified amylopectin polymer and/or oligomer has an average molecular weight of from about 5,000 to about 2,000,000.

10. The laundry additive composition of claim 6, wherein the modified amylopectin polymer and/or oligomer has an average molecular weight of from about 10,000 to about 1,000,000.

11. The laundry additive composition of claim 1, wherein the Degree of Substitution for group $R_H$ is between about 0.01 and 0.05.

12. The laundry additive composition of claim 1, wherein the Degree of Substitution for group $R_c$ wherein Z is H or M is between about 0.4 and 0.7.

13. The laundry additive composition of claim 6, wherein the Degree of Substitution for group $R_H$ is between about 0.01 and 0.05.

14. The laundry additive composition of claim 6, wherein the Degree of Substitution for group $R_c$ wherein Z is H or M is between about 0.4 and 0.7.

15. A method for treating a fabric in need of treatment comprising contacting the fabric with a modified amylopectin polymer and/or oligomer material according to claim 1 such that the fabric is treated.

16. The method according to claim 15 wherein said composition further comprises a modified amylose polmer and/of oligomer.

* * * * *

UNITED STATES PATENT AND TRADEMARK OFFICE

CERTIFICATE OF CORRECTION

PATENT NO. : 6,809,074 B2
DATED : October 26, 2004
INVENTOR(S) : Moe et al.

It is certified that error appears in the above-identified patent and that said Letters Patent is hereby corrected as shown below:

Title page,
Insert Item -- [*] Notice: This patent is subject to a Terminal Disclaimer --

Signed and Sealed this

Seventeenth Day of May, 2005

JON W. DUDAS
*Director of the United States Patent and Trademark Office*